US009109857B2

(12) United States Patent
Kendrick

(10) Patent No.: US 9,109,857 B2
(45) Date of Patent: Aug. 18, 2015

(54) HEIGHT AND ROTATION ADJUSTER FOR COMPETITION HOLSTER

(71) Applicant: Safariland, LLC, Jacksonville, FL (US)

(72) Inventor: Karl Kendrick, Winchester, CA (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 13/740,901

(22) Filed: Jan. 14, 2013

(65) Prior Publication Data

US 2013/0181018 A1 Jul. 18, 2013

Related U.S. Application Data

(60) Provisional application No. 61/585,893, filed on Jan. 12, 2012.

(51) Int. Cl.

| | |
|---|---|
| ***F41C 33/02*** | (2006.01) |
| ***F41C 33/00*** | (2006.01) |
| ***B65D 25/10*** | (2006.01) |
| ***A45C 1/04*** | (2006.01) |
| ***A45F 3/00*** | (2006.01) |
| ***F42B 39/02*** | (2006.01) |
| ***B60P 1/64*** | (2006.01) |
| ***B61D 45/00*** | (2006.01) |

(52) U.S. Cl.

CPC ..... *F41C 33/02* (2013.01); *F41C 33/0245* (2013.01)

(58) Field of Classification Search

CPC ..... F41C 33/02; F41C 33/04; B23Q 1/32

USPC ..... 224/198, 192, 242, 243, 244, 672, 673, 224/674, 911; 410/76, 90, 114, 122

See application file for complete search history.

(56) References Cited

U.S. PATENT DOCUMENTS

| | | | | |
|---|---|---|---|---|
| 3,952,930 | A * | 4/1976 | Baldocchi | 224/193 |
| 5,067,642 | A * | 11/1991 | Fodge | 224/192 |
| 5,167,355 | A * | 12/1992 | Hill | 224/193 |
| 5,372,288 | A * | 12/1994 | Rogers et al. | 224/198 |
| 5,419,472 | A * | 5/1995 | Hellweg et al. | 224/198 |
| 5,489,051 | A * | 2/1996 | Robinson | 224/148.4 |
| 5,551,610 | A * | 9/1996 | Clifton, Jr. | 224/197 |
| 5,598,958 | A | 2/1997 | Ryan, III et al. | |
| 6,575,343 | B2 * | 6/2003 | Mossman | 224/198 |
| 6,634,527 | B2 * | 10/2003 | Liu | 224/244 |
| 6,685,067 | B2 * | 2/2004 | French | 224/198 |
| 7,562,422 | B2 * | 7/2009 | D'Addario et al. | 24/701 |
| 2003/0042279 | A1 * | 3/2003 | Locklear, III | 224/244 |
| 2007/0278266 | A1 * | 12/2007 | Parsons | 224/197 |

OTHER PUBLICATIONS

Literature describing the Safariland Model 13 holster, which is admitted prior art.

* cited by examiner

*Primary Examiner* — Brian D Nash
*Assistant Examiner* — Derek Battisti
(74) *Attorney, Agent, or Firm* — Kane Kessler, P.C.; Paul E. Szabo

(57) ABSTRACT

A height and rotation adjuster for a competition holster includes an adjuster connected between a holster body and a drop arm. The adjuster includes a ball and socket joint for adjustably supporting the holster body on the drop arm.

11 Claims, 4 Drawing Sheets

HEIGHT AND ROTATION ADJUSTER FOR COMPETITION HOLSTER

RELATED APPLICATION

This is a nonprovisional application of U.S. Provisional Application No. 61/585,893 filed Jan. 12, 2012 by the same inventor, the benefit of the filing date of which is claimed, and the entire disclosure of which is hereby incorporated by reference.

BACKGROUND OF THE INVENTION

This invention relates to a device for adjustably supporting a holster for a gun. In particular, the invention relates to an adjuster that provides height and rotation adjustment for a competition holster for a competitive pistol shooter.

One form of competitive shooting involves drawing and firing a pistol as quickly as possible. To that end, pistol holsters have been developed which are quite different from holsters used as police duty gear. One known example is the Safariland Model 013. This device includes a belt clip; a drop arm attached to the belt clip; and the holster body itself, attached to the drop arm. The holster is designed to releasably hold a pistol in a manner that enables the shooter to achieve a shooting grip and remove the pistol from the holster very quickly, while the holster still safely retains the pistol at other times.

A competition holster of this type is usually adjustable in several aspects. For example, the height (vertical position) of the holster body is adjustable along the drop arm, relative to the belt clip. Also, the angle of the holster body is adjustable relative to the drop arm. These adjustments enable a shooter to set the position and orientation of the holster body (and the gun therein) to provide for the fastest draw.

The Model 013 competition holster includes two separate screws for adjusting the height and the angle of the holster. Thus, two separate procedures are needed to set (or reset) the holster. The present invention provides a new and improved adjuster for enabling adjustment of a competition holster, and a holster incorporating such an adjuster.

DETAILED DESCRIPTION

Figure 1:
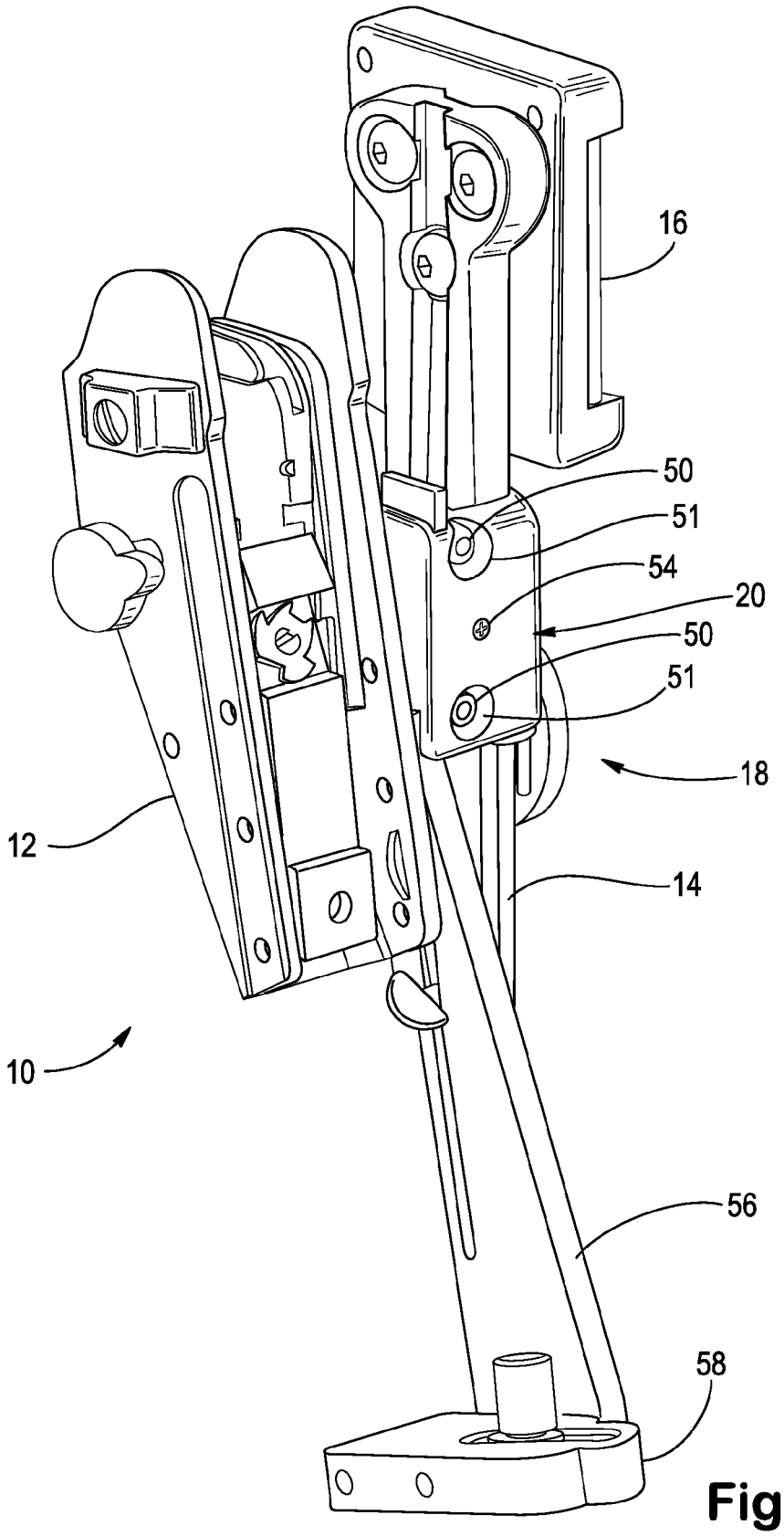
FIG. 1 is a perspective view of a holster that is a first embodiment of the invention.
Figure 2:
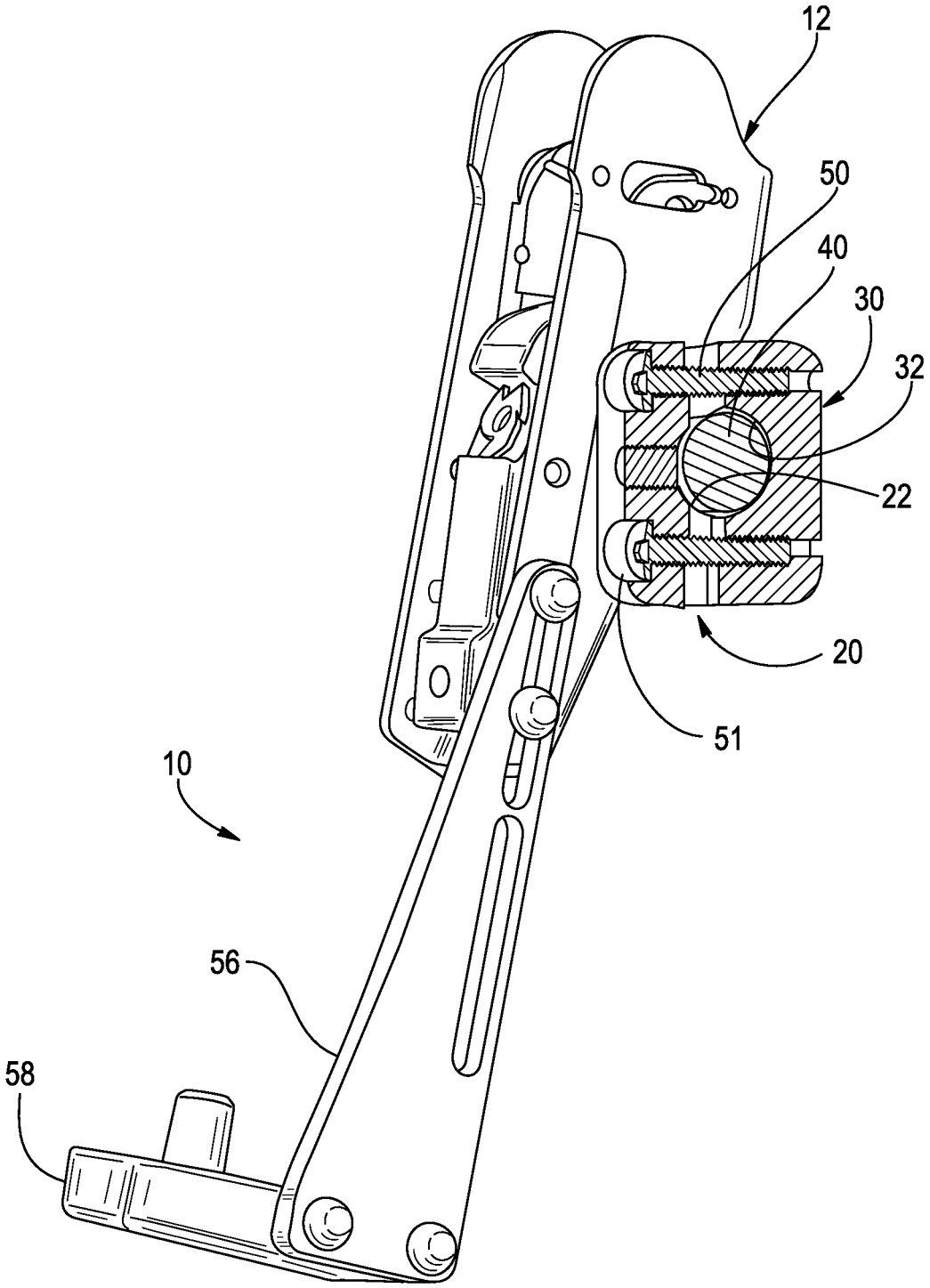
FIG. 2 is another perspective view of the holster of FIG. 1.
Figure 3:
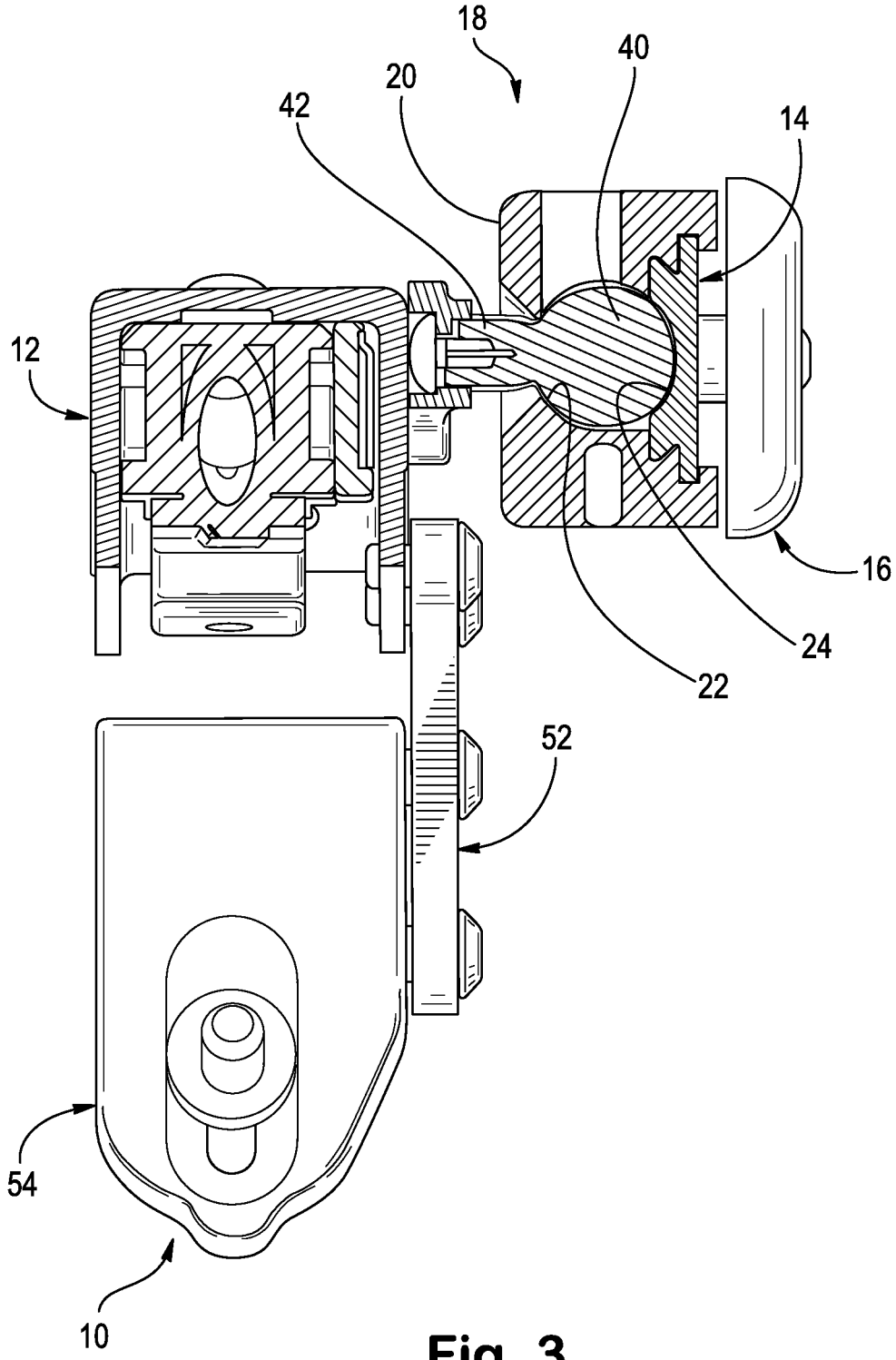
FIG. 3 is a cross-sectional view of the holster of FIG. 1.
Figure 4:
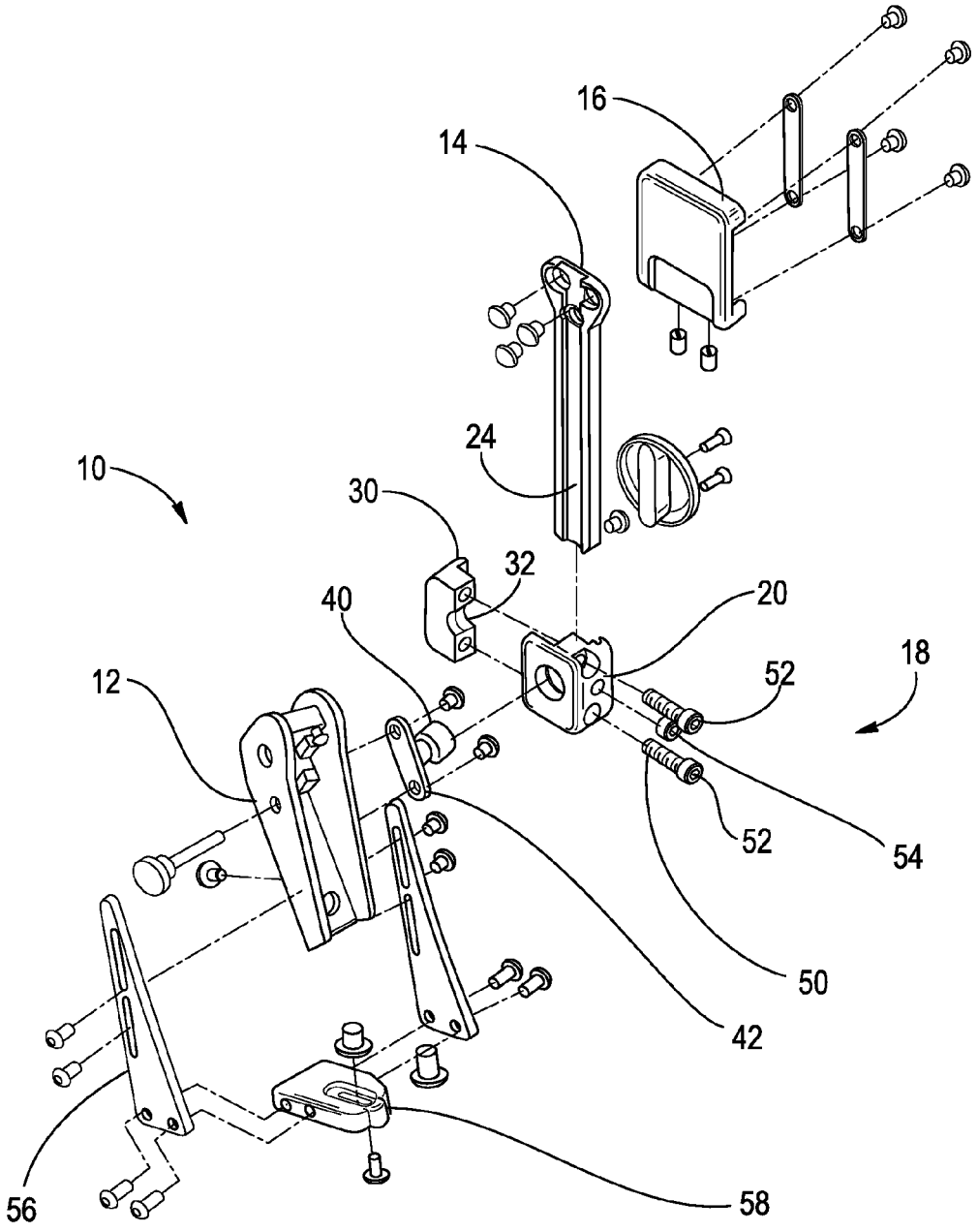
FIG. 4 is an exploded perspective view of the holster of FIG. 1.

The invention is illustrated in one embodiment as a holster 10. The holster 10 includes a holster body 12; a drop arm 14 for supporting the holster body; a belt clip 16 connected with the drop arm for supporting the drop arm on a user's belt, thereby to support the holster body on the user's belt; and an adjuster 18 connected between the holster body and the drop arm and adjustably supporting the holster body on the drop arm.

The adjuster 18 includes a housing 20 that is slidable vertically along the drop arm 14. The housing 20 has a spherical surface 22, which partially defines a socket 24. In addition, the drop arm 14 has a cylindrical surface 24 on its inside, extending along the length of the drop arm, which partially defines the socket 24.

A clamp 30 is slidably connected with the housing 20 and is located on a first side of the socket 24. The clamp 30 has a spherical surface 32 that is presented toward the spherical surface 40 on the housing. The three surfaces 22, 24, and 32 together define the socket 24.

A ball 40 is located in the socket 24. A pin 42 extends radially from the ball 40, in a direction away from the drop arm 14. The pin 42 is rigidly connected with the holster body 12. As a result, the holster body 12 is rigidly connected with the ball 40, and motion of the holster body translates into motion of the ball.

Two adjuster members in the form of screws 50 are inserted in through holes 51 in a second side of the housing 20 opposite the first side and thus opposite the clamp 30. The screws 50 extend from the second side of the housing 20, past the socket 24, to the first side of the housing, The screws 50 are screwed into threaded openings in the clamp 30. The heads 52 of the adjuster screws 50 bottom out on a surface on the second side of the housing 20. As a result, when the adjuster screws 50 are tightened sufficiently, they draw the clamp 30 toward the heads 52 of the screws, thus closing the socket 24 and clamping the ball 40 in the socket 24.

When at least one of the two adjuster screws 50 is loose enough, the clamp 30 does not tightly engage the ball 40, and the ball 40 does not tightly engage the cylindrical surface 24 on the drop arm 14. As a result, the housing 20 and the ball 40 can be moved (together) vertically along the drop arm 14, to adjust the height of the holster body 12 on the drop arm 14. In addition, when at least one of the two adjuster screws 50 is loose enough, the ball 40 does not tightly engage the spherical surface 22 on the housing 20. As a result, the ball 40 can rotate relatively freely in the socket 24 of the housing 20, thereby to adjust the angle (pivotal or rotational position) of the holster body 12 relative to the drop arm 14.

When the two adjuster screws 50 are both tightened, they draw the spherical surface 32 on the clamp 30 toward and into engagement with the ball 40. The ball 40 is drawn into engagement with the spherical surface 22 on the housing 20. The ball 40 is clamped between the clamp 30 and the housing 20. This clamping engagement prevents rotation of the ball 40 within the housing 20, and thus locks the angle of the holster body 12 relative to the drop arm 14.

In addition, and at the same time, the ball 40 is drawn into engagement with the cylindrical surface 24 on the drop arm 14. This engagement prevents movement of the ball 40 (and thereby the housing 20) vertically along the drop arm 14, and thus locks the height of the holster body 12 along the drop arm.

To initially set the position of the holster body 12 using the adjuster 18, both adjuster screws 50 are screwed into the clamp 30 until finger tight. The user then moves the holster body 12 vertically to the desired height along the drop arm 14, while holding the holster body, and then tightens one of the adjuster screws 50 until the adjuster 18 stops moving vertically. The user then pivots the holster body 12 to the desired angle relative to the drop arm 14, and tightens the one adjuster screw 50 further until the holster body stops pivoting. The user then tightens the second adjuster screw 50.

To adjust the position of the holster body 12 after it has been set initially, one of the adjuster screws 50 is loosened slightly. The holster body 12 and ball 40 can then pivot. Further loosening of the one adjuster screw 50 enables the adjuster 18 to be moved vertically along the drop arm 14. The second adjuster screw 50 acts as a guide rod to keep the clamp 30 moving parallel to the axis of the first adjuster screw 50. A set screw 54 is also provided that can be tightened down onto the outer surface of the ball 40, as a secondary locking mechanism.

The drawings also show a bar 56 and plate 58 that the end of the barrel of the pistol rests on. The plate 58 has a tip that fits into the barrel and limits the rotational travel of the pistol in the holster body 12.

The heads of the two adjuster screws 50, and the head of the set screw 54, are all located adjacent each other, on a forward, exposed outward area of the adjuster 18. Thus, all three screws 50 and 54 are readily accessible, in the same area, without removing the gun from the holster 10 and without removing the holster from the wearer's leg. In addition, access to the vertical adjustment mechanism is at the same location as access to the pivotal adjustment mechanism.

The invention claimed is:

1. An apparatus comprising:

a holster body;

a drop arm for supporting the holster body;

a belt clip connected with the drop arm for supporting the drop arm on a user's belt, thereby to support the holster body on the user's belt; and an adjuster connected between the holster body and the drop arm and movable vertically along the drop arm, the adjuster supporting the holster body on the drop arm for vertical movement together with the adjuster relative to the drop arm among a plurality of different operational positions and the adjuster supporting the holster body for rotational movement relative to the drop arm and relative to the adjuster;

the adjuster comprising a housing at least partially defining a socket, and a ball in the socket, the ball being fixed for movement with the holster body.

2. Apparatus as set forth in claim 1 wherein the adjuster has a first condition in which the ball is rotatable in the socket and the housing can move along the drop arm and the holster body can be pivoted relative to the drop arm, and a second condition in which the ball is not rotatable in the socket and the housing is fixed in position along the drop arm and the pivotal position of the holster body is fixed relative to the drop arm.

3. Apparatus as set forth in claim 2 including a clamp movable relative to the ball and the housing, and two adjuster members that are selectively operable to tighten the clamp on the ball and the housing.

4. Apparatus as set forth in claim 3 wherein the housing and the clamp and the drop arm have curved surfaces that are clampingly engaged with the ball when the clamp is tightened on the ball.

5. Apparatus as set forth in claim 1 wherein the drop arm has a cylindrical surface extending along at least a portion of its length, the cylindrical surface being selectively engageable with the ball to control movement and positioning of the housing and thereby the holster body along the drop arm.

6. Apparatus as set forth in claim 2 including a clamp movable relative to the ball and the housing, and two adjuster members that are selectively operable to tighten the clamp on the ball and the housing.

7. Apparatus as set forth in claim 1 including a clamp movable relative to the ball and the housing, and two adjuster screws that are selectively operable to tighten the clamp on the ball and the housing;

the housing and the clamp each having spherical surfaces partially defining the socket, and the drop arm having a cylindrical surface partially defining the socket;

the spherical surfaces on the housing and the clamp and the cylindrical surface on the drop arm being engaged with the ball when the adjuster screws are tightened.

8. An apparatus comprising:

a holster body;

a drop arm for supporting the holster body;

a belt clip connected with the drop arm for supporting the drop arm on a user's belt, thereby to support the holster body on the user's belt; and a ball and socket mechanism connected between the holster body and the drop arm and movable vertically along the drop arm, the ball and socket mechanism supporting the holster body on the drop arm for vertical movement together with the ball and socket mechanism relative to the drop arm among a plurality of different operational positions and the ball and socket mechanism supporting the holster body for rotational movement relative to the drop arm and relative to the ball and socket mechanism.

9. An apparatus comprising:

a holster body;

a drop arm for supporting the holster body, a belt clip connected with the drop arm for supporting the drop arm on a user's belt, thereby to support the holster body on the user's belt; and an adjuster connected between the holster body and the drop arm and supporting the holster body on the drop arm for pivotal and rotational movement relative to the drop arm;

the adjuster comprising a housing at least partially defining a socket, and a ball in the socket, the ball being fixed for movement with the holster body;

wherein the adjuster includes two adjuster screws that are together operable to control the pivotal and vertical position of the holster along the drop arm, the heads of the two adjuster screws being located adjacent each other on an exposed outward area of the adjuster to be readily accessible in the same area without removing the gun from the holster and without removing the holster from the wearer's leg.

10. An apparatus comprising:

a holster body;

a drop arm for supporting the holster body;

a belt clip connected with the drop arm for supporting the drop arm on a user's belt, thereby to support the holster body on the user's belt; and a ball and socket mechanism connected between the holster body and the drop arm and supporting the holster body on the drop arm for pivotal and rotational movement relative to the drop arm; and comprising two manually engageable adjuster members that are together operable to control the tightness of the ball and socket mechanism, the adjuster members being located adjacent each other on an exposed outward area of the adjuster to be readily accessible in the same area without removing the gun from the holster and without removing the holster from the wearer's leg.

11. An apparatus comprising:

a holster body;

a drop arm for supporting the holster body;

a belt clip connected with the drop arm for supporting the drop arm on a user's belt, thereby to support the holster body on the user's belt;

a ball and socket mechanism connected between the holster body and the drop arm and supporting the holster body on the drop arm for pivotal and vertical movement relative to the drop arm; and two manually engageable adjuster members that are together operable to control the tightness of the ball and socket mechanism;

wherein the dimensions of the parts of the ball and socket mechanism are selected so that loosening of only the first adjuster member enables pivotal movement of the holster body relative to the drop arm, and loosening of both the first and second adjuster members allows vertical movement of the holster body relative to the drop arm.

* * * * *